US011257614B2

(12) United States Patent
Cheng et al.

(10) Patent No.: US 11,257,614 B2
(45) Date of Patent: Feb. 22, 2022

(54) INTEGRATED VERTICAL INDUCTOR

(71) Applicant: CYNTEC CO., LTD., Hsinchu (TW)

(72) Inventors: Hsin-Jung Cheng, Hsinchu (TW); Ming-Tsung Pan, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 386 days.

(21) Appl. No.: 16/177,391

(22) Filed: Oct. 31, 2018

(65) Prior Publication Data

US 2019/0139690 A1 May 9, 2019

Related U.S. Application Data

(60) Provisional application No. 62/581,043, filed on Nov. 3, 2017.

(51) Int. Cl.

| | |
|---|---|
| ***H01F 27/30*** | (2006.01) |
| ***H01F 17/00*** | (2006.01) |
| ***H01F 27/32*** | (2006.01) |
| ***H01F 27/24*** | (2006.01) |
| ***H01F 27/28*** | (2006.01) |
| ***H01F 27/02*** | (2006.01) |
| ***H01F 27/26*** | (2006.01) |
| ***H01F 27/29*** | (2006.01) |

(52) U.S. Cl.

CPC ..... *H01F 17/0013* (2013.01); *H01F 27/027* (2013.01); *H01F 27/24* (2013.01); *H01F 27/263* (2013.01); *H01F 27/2804* (2013.01); *H01F 27/2823* (2013.01); *H01F 27/29* (2013.01); *H01F 27/325* (2013.01); *H01F 2017/008* (2013.01); *H01F 2017/0093* (2013.01); *H01F 2027/2809* (2013.01); *H01F 2027/297* (2013.01)

(58) Field of Classification Search

CPC ..... H01F 27/325
USPC ..... 336/198
See application file for complete search history.

(56) References Cited

U.S. PATENT DOCUMENTS 4,238,753 A * 12/1980 Bayer ..... H01F 5/04 336/178
5,117,215 A * 5/1992 Kakehashi ..... H01F 3/14 336/178
5,602,519 A 2/1997 Kim
5,696,477 A * 12/1997 Yamamori ..... H01F 27/027 336/185

(Continued)

FOREIGN PATENT DOCUMENTS

CN 1581381 A 2/2005
CN 201298430 Y 8/2009

(Continued)

*Primary Examiner* — Ronald Hinson
(74) *Attorney, Agent, or Firm* — Winston Hsu

(57) ABSTRACT

An integrated vertical inductor includes a bobbin having an elongated, hollow tube, an upper flange disposed at an upper end of the elongated, hollow tube, and a base structure integrated with a lower end of the elongated, hollow tube. The elongated, hollow tube comprises a central opening extending along its longitudinal direction. The base structure comprises a lateral opening communicating with the central opening. A first magnetic core piece is installed in the central opening of the elongated, hollow tube. A second magnetic core piece is juxtaposed with the first magnetic core piece. A plurality of electrodes is disposed on a bottom surface of the base structure.

22 Claims, 7 Drawing Sheets

(56) References Cited

U.S. PATENT DOCUMENTS

| | | | | | |
|---|---|---|---|---|---|
| 6,002,319 | A * | 12/1999 | Honma | H01F 27/38 | 336/178 |
| 8,334,745 | B2 * | 12/2012 | Chen | H01F 38/10 | 336/198 |
| 2006/0164197 | A1 | 7/2006 | Wu | | |
| 2007/0246594 | A1 * | 10/2007 | Pan | H01F 27/325 | 242/474.4 |
| 2012/0038448 | A1 * | 2/2012 | Kim | H01F 27/325 | 336/192 |
| 2014/0055226 | A1 | 2/2014 | Hsieh | | |

FOREIGN PATENT DOCUMENTS

| | | | |
|---|---|---|---|
| CN | 201336209 | Y | 10/2009 |
| CN | 201402728 | Y | 2/2010 |
| CN | 201449860 | U | 5/2010 |
| CN | 201966043 | U | 9/2011 |
| CN | 203552897 | U | 4/2014 |
| CN | 203850120 | U | 9/2014 |
| KR | 10-2006-0085905 | A | 7/2006 |
| TW | I539473 | B | 6/2016 |

* cited by examiner

INTEGRATED VERTICAL INDUCTOR

CROSS REFERENCE TO RELATED APPLICATIONS

This application claims priority from U.S. provisional application No. 62/581,043 filed Nov. 3, 2017, which is included herein in its entirety by reference.

BACKGROUND OF THE INVENTION

1. Field of the Invention

The present invention relates to an electronic component. More particularly, the present invention relates to an integrated vertical inductor having common-mode inductance and differential-mode inductance.

2. Description of the Related Art

As known in the art, an electromagnetic interference (EMI) filter is generally composed of a common-mode inductance element and a differential-mode inductance element. Typically, the designs of the cores of the inductor with integrated individually differential mode inductance or common mode inductance are usually Toroidal core, ET type, UT type, UU type or EE/EI type core.

Toroidal core produces a closed magnetic path, very difficult to make high leakage inductance (high differential-mode inductance value) and is usually about dozens of μH or so. Toroidal core cannot be processed by automated winding in a small volume because the core diameter is too small. Due to the shapes of the cores of ET type and UT type, the bobbin must be split into two parts. Winding can be performed by disposing the gear in the bobbin and then utilizing the base of bobbin to line management in artificial way. These two structures are not easy to be miniaturized, cannot be fully automated operated, and not easy to have a high leakage inductance value.

UU type core is suitable for horizontal design. When it is changed to vertical, the spacing between the bottom core and the four pins is too short, which leads to Hi-pot test failure (withstand voltage decreased). Limited by the vertical core group structure of UU type, this structure can only to increase the spacing of four pins (safe distance) to solve the problem of Hi-pot flashover, however, which results in the problem of larger volume. Two winding groups of EE/EI type must be wound on both of the side columns. Although EE/EI type has a high degree of automation, it sacrifices the overall space.

SUMMARY OF THE INVENTION

It is one object of the present invention to provide an improved integrated vertical inductor having common-mode inductance and differential-mode inductance in order to solve the above-described prior art shortcomings.

According to one aspect of the invention, an integrated vertical inductor is disclosed. The integrated vertical inductor includes a bobbin having an elongated, hollow tube, an upper flange disposed at an upper end of the elongated, hollow tube, and a base structure integrated with a lower end of the elongated, hollow tube. The elongated, hollow tube comprises a first spool part and a second spool part disposed between the upper flange and the base structure. The second spool part extends coaxially from the first spool part. The elongated, hollow tube comprises a central opening extending along its longitudinal direction. The base structure comprises a lateral opening communicating with the central opening. A first coil unit comprising windings of first wire is wound on the first spool part. A second coil unit comprising windings of second wire is wound on the second spool part. An intermediate flange is disposed on the elongated, hollow tube between the first spool part and the second spool part. The first coil unit is separated from the second coil unit by the intermediate flange. A first magnetic core piece is installed in the central opening of the elongated, hollow tube. A second magnetic core piece is juxtaposed with the first magnetic core piece. The intermediate flange comprises an intermediate recessed structure for tenoning a connecting bar of the second magnetic core piece. The intermediate flange comprises two first arm portions around the intermediate recessed structure. Each of the two first arm portions comprises a first wire guiding groove for guiding the wire from the first coil unit. A plurality of electrodes is disposed on a bottom surface of the base structure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the embodiments, and are incorporated in and constitute apart of this specification. The drawings illustrate some of the embodiments and, together with the description, serve to explain their principles. In the drawings.

DETAILED DESCRIPTION

Figure 1:
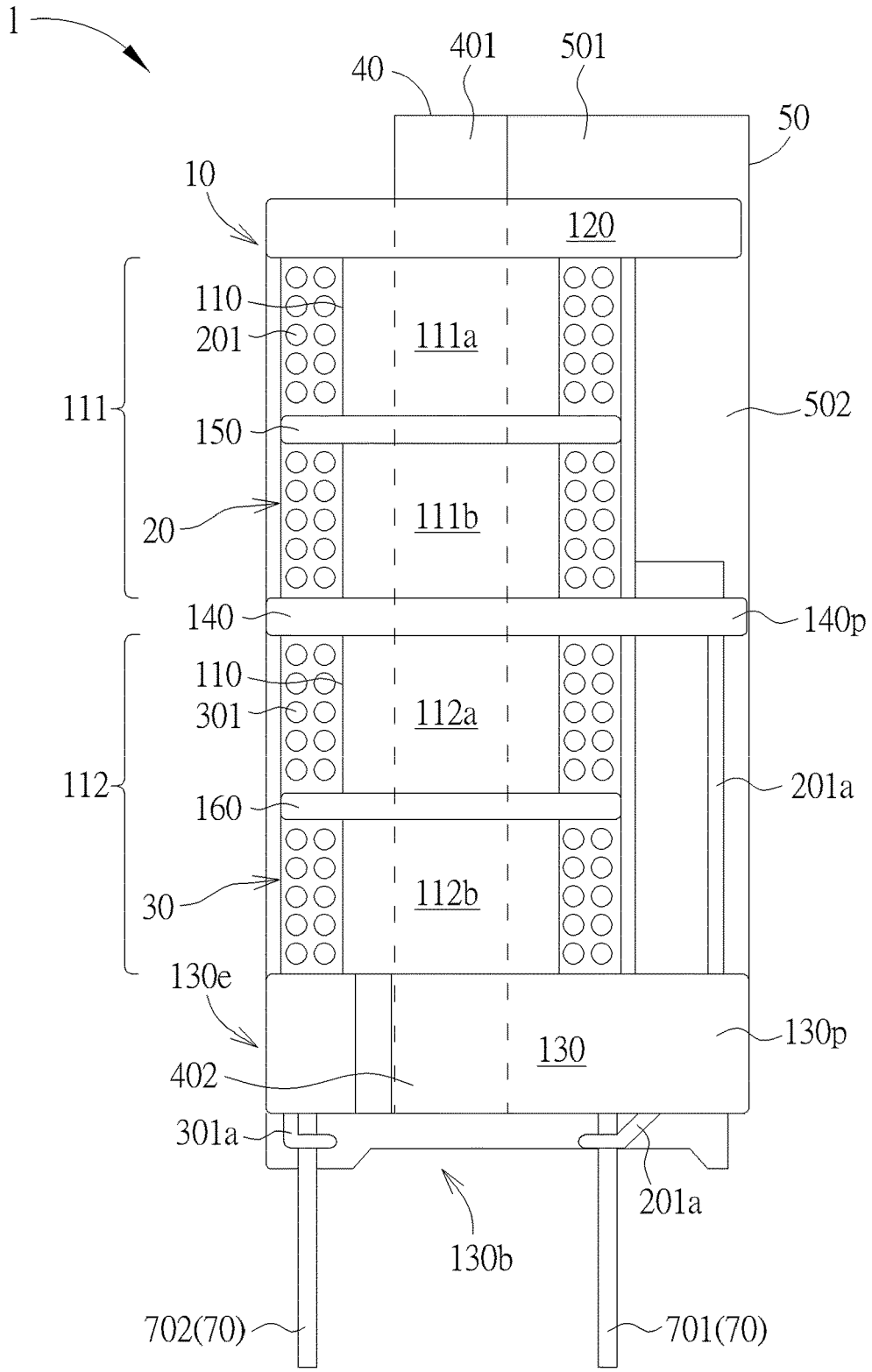
FIG. 1 is a schematic, cross-sectional diagram showing an integrated vertical inductor with both common-mode inductance and differential-mode inductance according to one embodiment of the invention.

In the following description, numerous specific details are given to provide a thorough understanding of the invention. It will, however, be apparent to one skilled in the art that the invention may be practiced without these specific details. Furthermore, some well-known system configurations and process steps are not disclosed in detail, as these should be well-known to those skilled in the art.

Likewise, the drawings showing embodiments of the apparatus are semi-diagrammatic and not to scale and some dimensions are exaggerated in the figures for clarity of presentation. Also, where multiple embodiments are disclosed and described as having some features in common, like or similar features will usually be described with like reference numerals for ease of illustration and description thereof.

The term "horizontal" as used herein is defined as a plane parallel to the conventional major plane or surface of the semiconductor chip or die substrate, regardless of its orientation. The term "vertical" refers to a direction perpendicular to the horizontal as just defined. Terms, such as "on", "above", "below", "bottom", "top" "side" (as in"w" "h" "w" "v", and "under", are defined with respect to the horizontal plane.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

The present invention pertains to an integrated vertical inductor that integrates a common mode inductance element and a differential mode inductance element into a single element with integrated differential and common mode inductance. The inductor of the present invention utilizes the leakage inductance generated between two windings to replace the original differential-mode inductance element. The inductor not only retains the high impedance characteristic of the original common mode inductance but also integrates the differential-mode inductance, thereby omitting a differential-mode inductance element, so as to save the cost of the EMI filter and the area occupied by the components.

Figure 2:
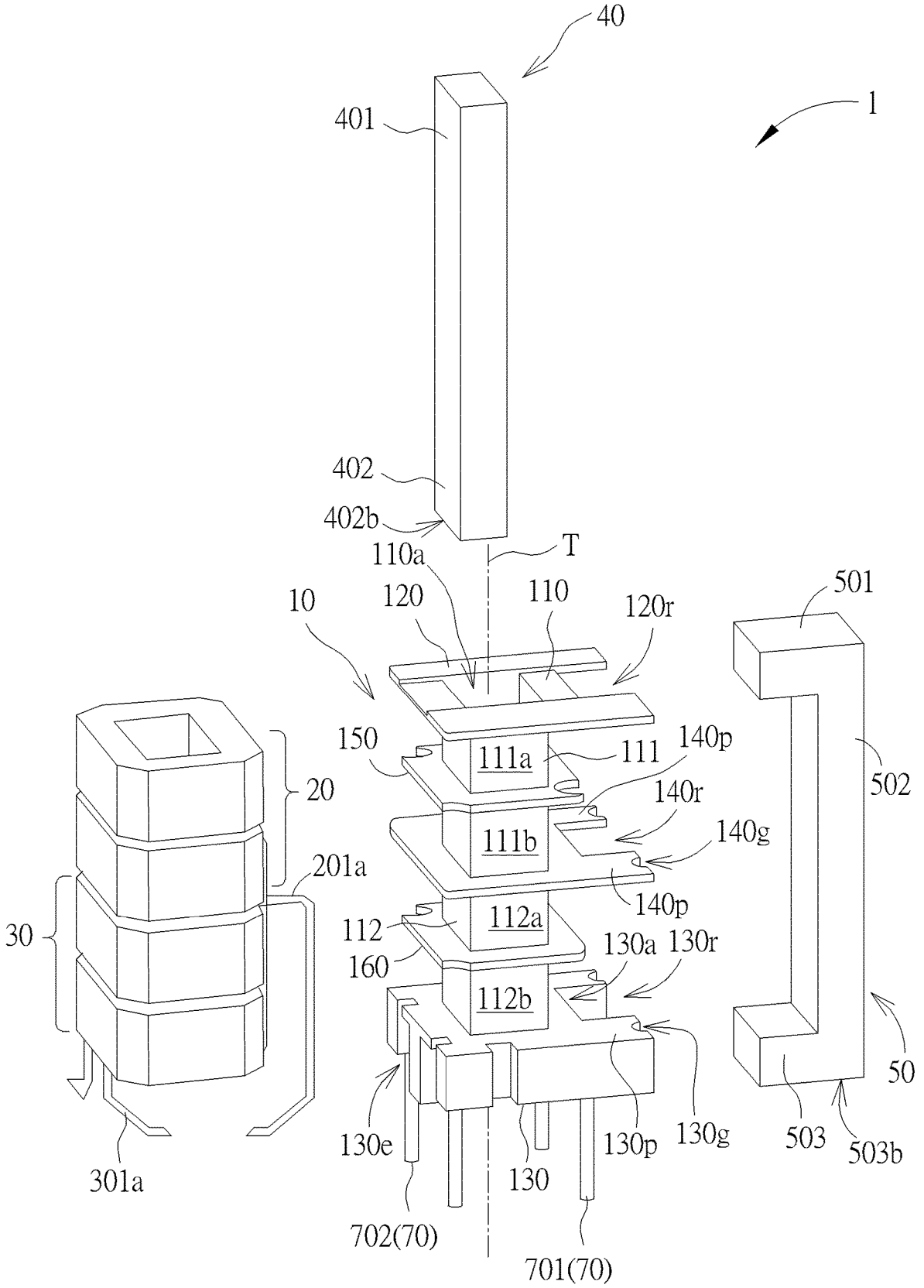
FIG. 2 is an exploded perspective view of the integrated vertical inductor of FIG. 1.

Please refer to FIG. 1 and FIG. 2. FIG. 1 is a schematic, cross-sectional diagram showing an integrated vertical inductor with both common-mode inductance and differential-mode inductance according to one embodiment of the invention. FIG. 2 is an exploded perspective view of the integrated vertical inductor of FIG. 1. As shown in FIG. 1 and FIG. 2, the integrated vertical inductor 1 comprises a bobbin 10 that is generally composed of an elongated, hollow tube 110, an upper flange 120 disposed at an upper end of the elongated, hollow tube 110, and a base structure 130 integrated with a lower end of the elongated, hollow tube 110.

According to one embodiment of the invention, the bobbin 10 is preferably integrally made of a plastic material which has the desired electrical characteristics, which can be easily molded. According to one embodiment of the invention, the bobbin 10 is preferably a one-piece winding bobbin. According to one embodiment of the invention, the bobbin 10 is preferably made of a monolithic plastic material.

According to one embodiment of the invention, the elongated, hollow tube 110 may have a rectangular cuboidal shape with a longitudinal length. According to one embodiment of the invention, the elongated, hollow tube 110 may comprise a first spool part 111 and a second spool part 112 disposed between the upper flange 120 and the base structure 130. According to one embodiment of the invention, the second spool part 112 extends coaxially from the first spool part 111. An intermediate flange 140 is disposed on the elongated, hollow tube 110 between the first spool part 111 and the second spool part 112.

According to one embodiment of the invention, the elongated, hollow tube 110 comprises a vertical, central opening 110*a* (hereinafter referred to as "central opening") extending along its longitudinal direction. The base structure 130 comprises a horizontal or lateral opening 130*a* (hereinafter referred to as "lateral opening"). The lateral opening 130*a* communicating with the central opening 110*a* to thereby form an L shaped opening inside the bobbin 10.

According to one embodiment, the elongated, hollow tube 110, the upper flange 120, the base structure 130, the intermediate flange 140 are all integral parts of the bobbin 10, which together form a one-piece winding bobbin. According to one embodiment of the invention, the elongated, hollow tube 110 has a tube axis T that is oriented vertical to a mounting surface of a device. For example, the tube axis T may be perpendicular to a main surface of a printed circuit board (PCB) and the mounting surface may be in parallel with the main surface of the PCB.

As shown in FIG. 1 and FIG. 2, according to one embodiment of the invention, a first coil unit 20 comprising windings of first wire 201 is wound on the first spool part 111, and a second coil unit 30 comprising windings of second wire 301 is wound on the second spool part 112. According to one embodiment of the invention, for example, the first wire 201 and the second wire 301 may be copper wires covered with insulation resin. According to one embodiment of the invention, the first coil unit 20 is separated from the second coil unit 30 by the intermediate flange 140. The windings of first wire 201 and the windings of second wire 301 are wound separately and are wound along the same winding axis in the vertical direction of the bobbin 10, making it easy to implement automatic winding.

According to one embodiment of the invention, a first magnetic core piece 40 is inserted into the central opening 110*a* of the elongated, hollow tube 110. For example, the first magnetic core piece 40 may be an I core. A second magnetic core piece 50 is juxtaposed with the first magnetic core piece 40. For example, the second magnetic core piece 50 may be a U core or an E core. However, it is to be understood that the two-part core consisting of the first magnetic core piece 40 and the second magnetic core piece 50 may be selected from a group consisting of I-U core, I-E core, L-L core, and L-F core. For example, the first magnetic core piece 40 is an I core and the second magnetic core piece 50 is a U core. For example, the first magnetic core piece 40 is an I core and the second magnetic core piece 50 is an E core.

According to one embodiment of the invention, the upper end of the elongated, hollow tube 110 may include a joint plane (side or top surface) joined to the second magnetic core piece 50, and the horizontal cross section thereof is in a polygonal shape, preferably a rectangular shape so as to achieve a higher volume utilization ratio.

According to one embodiment of the invention, the upper flange 120 comprises an upper recessed structure 120*r* for tenoning or fixing an upper leg 501 of the second magnetic core piece 50. According to one embodiment of the invention, the upper leg 501 of the second magnetic core piece 50 is joined to an upwardly protruding portion 401 of the first magnetic core piece 40, which protrudes from a top surface of the upper flange 120 around the central opening 110*a*. According to one embodiment of the invention, the upper flange 120 may have a surface directly joined to the second magnetic core piece 50. According to one embodiment of the invention, the second magnetic core piece 50 may be adhered to the upper flange 120 by using an adhesive (not explicitly shown).

According to one embodiment of the invention, the intermediate flange 140 may comprise an intermediate recessed structure 140*r* for tenoning or fixing a connecting bar 502 of the second magnetic core piece 50. According to one embodiment of the invention, the intermediate flange 140 comprises two first arm portions 140*p*, disposed on a side that is opposite to the second pair of electrodes (terminal pins 702), for example, around the intermediate recessed structure 140*r*. According to one embodiment of the invention, each of the two first arm portions 140*p* comprises a first wire guiding groove 140*g* for guiding first end 201*a* of the windings of first wire 201 extending from the first coil unit 20. The distance between the first end 201*a* and the second spool part 112 is approximately equal to the length of the first arm portions 140*p*. According to one embodiment of the invention, the upper leg 501 of the second magnetic core piece 50 may be joined to the upwardly protruding portion 401 of the first magnetic core piece 40 by an adhesive layer (not explicitly shown).

According to one embodiment of the invention, the base structure 130 may comprise a lower recessed structure 130*r* for tenoning or fixing a lower leg 503 of the second magnetic core piece 50. According to one embodiment of the invention, the entire lower leg 503 may be disposed in the lateral opening 130*a*. According to one embodiment of the invention, as can be best seen in FIG. 1, an entire bottom surface 503*b* of the lower leg 503 of the second magnetic core piece 50 and a bottom surface 402*b* of the lower portion 402 of the first magnetic core piece 40 are covered with the base structure 130 and are not exposed.

According to one embodiment of the invention, the lower leg 503 may be joined to a lower portion 402 of the first magnetic core piece 40 by an adhesive layer in the lateral opening 130*a*. According to one embodiment of the invention, the base structure 130 may comprise two second arm portions 130*p* around the lower recessed structure 130*r*. According to one embodiment of the invention, each of the two second arm portions 130*p* may comprise a second wire guiding groove 130*g* for guiding the first end 201*a* of the windings of first wire 201 extending from the first coil unit 20 to a bottom surface of the base structure 130. According to one embodiment of the invention, the height of the assembly device is greater than the length of both sides of the bottom surface 130*b* of the base structure 130.

Figure 3:
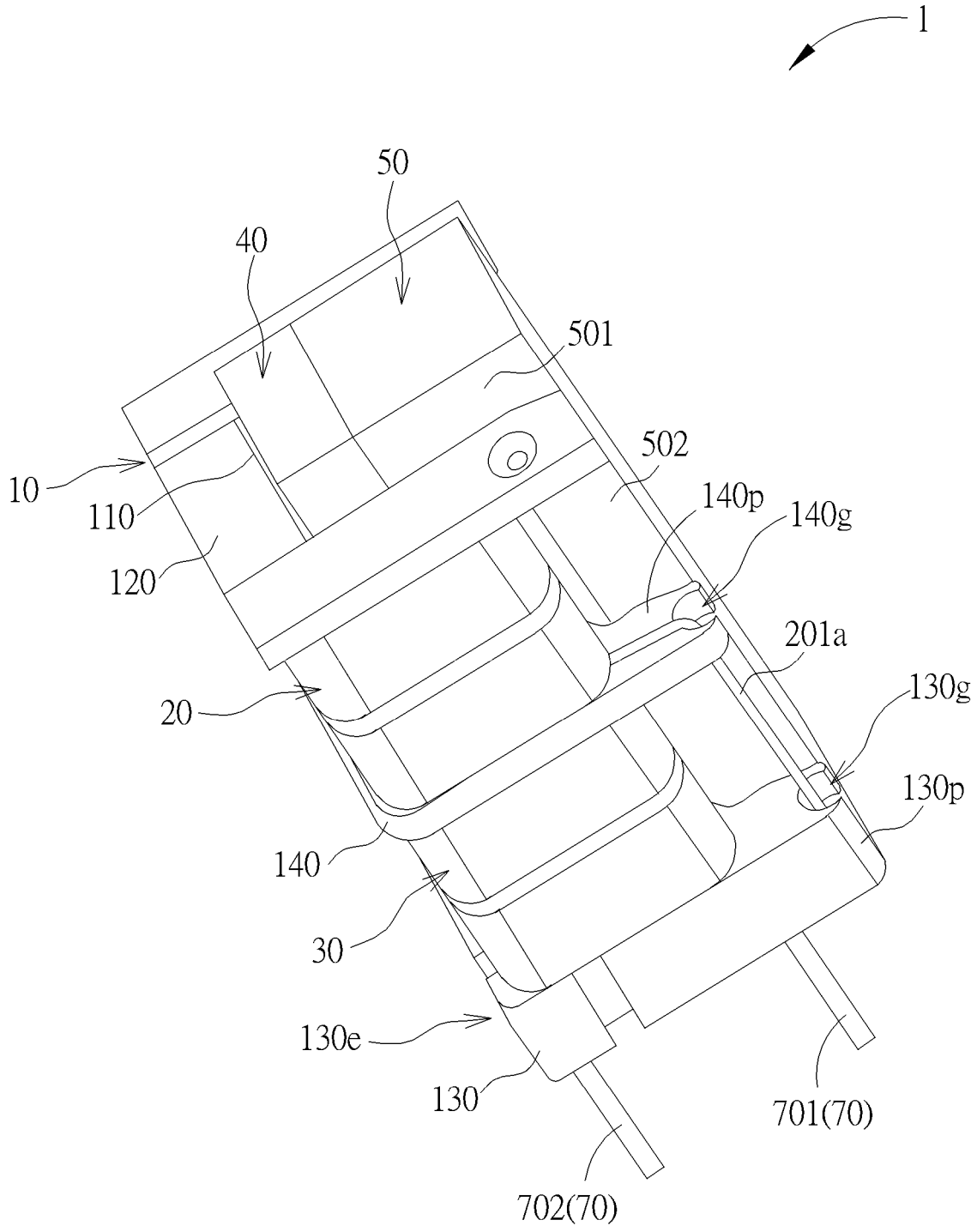
FIG. 3 and FIG. 4 are perspective views of the integrated vertical inductor of FIG. 1.
Figure 4:
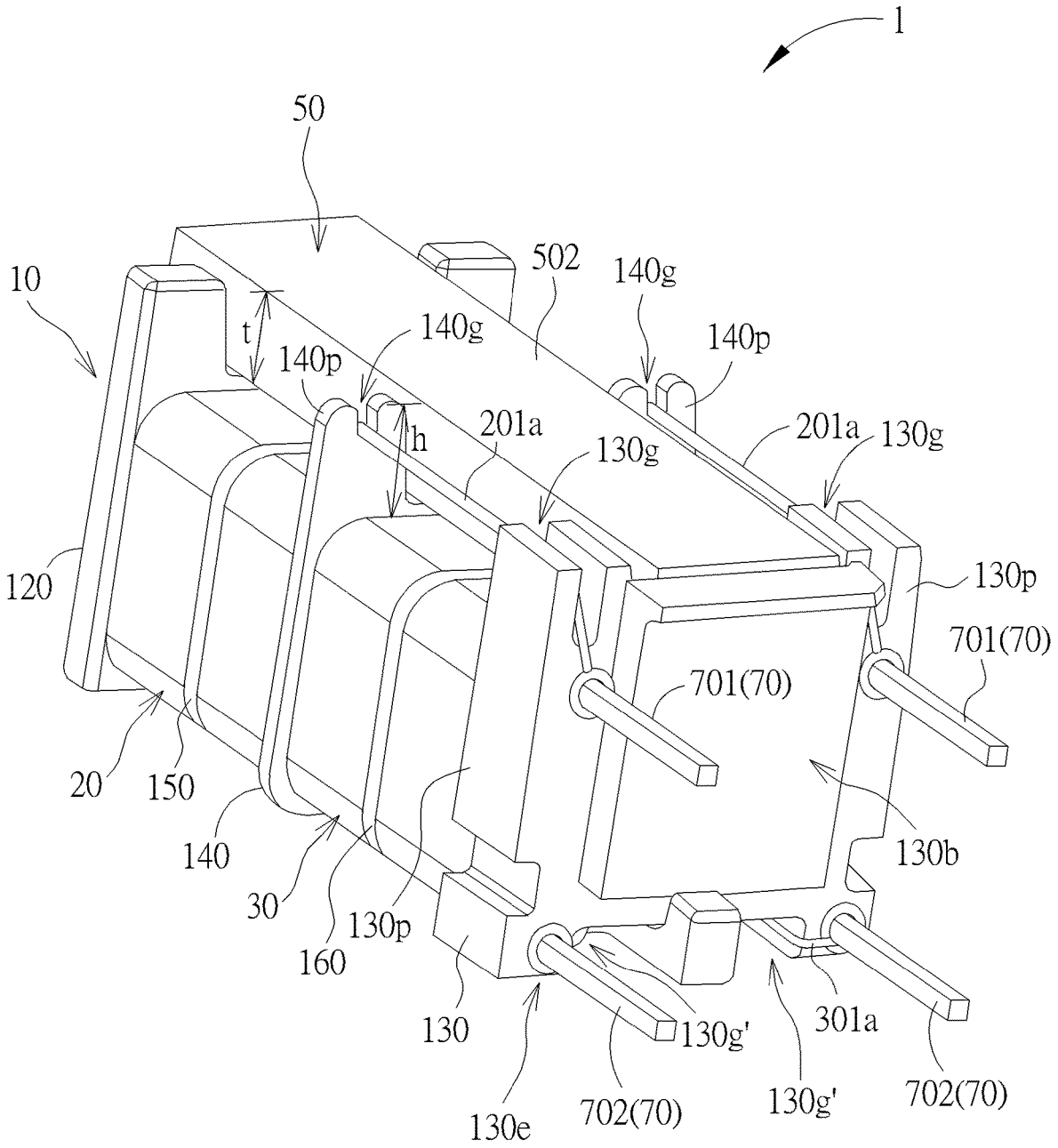

Please also refer to FIG. 3 and FIG. 4. FIG. 3 and FIG. 4 are perspective views of the integrated vertical inductor of FIG. 1. As shown in FIG. 3 and FIG. 4, a plurality of electrodes 70 such as pins or pads is installed on the bottom surface 130*b* of the base structure 130. For example, the plurality of electrodes 70 includes a first pair of terminal pins 701 and a second pair of terminal pins 702 protruding from the bottom surface 130*b* of the base structure 130. The first pair of terminal pins 701 and the second pair of terminal pins 702 are respectively disposed on opposite sides of the base structure 130. The first pair of terminal pins 701 is situated adjacent to the two second arm portions 130*p*. The second pair of terminal pins 702 is situated adjacent to an edge 130*e* that is opposite to the two second arm portions 130*p* of the base structure 130.

According to one embodiment of the invention, the wires 201 continuously extending from the first coil unit 20 may be guided to the bottom surface 130*b* of the base structure 130 through the second wire guiding grooves 130*g* and may be electrically connected to the first pair of terminal pins 701 by soldering. As can be seen in FIG. 4, the height h of the first arm portions 140*p* and the second arm portions 130*p* may be approximately equal to the thickness t of the connecting bar 501 of the second magnetic core piece 50. The first arm portions 140*p*, the second arm portions 130*p*, the first wire guiding grooves 140*g*, and the second wire guiding grooves 130*g* effectively avoid potential interference or shorting between the wires 201 and between the wires 201 and the second magnetic core piece 50.

According to one embodiment of the invention, the base structure 130 further comprises third wire guiding grooves 130*g*' for guiding a second end 301*a* of wires 301 extending from the second coil unit 30 to the bottom surface 130*b* of the base structure 130. The second end 301*a* of wires 301 extending from the second coil unit 30 may be guided to the bottom surface 130*b* of the base structure 130 through the third wire guiding groove 130*g*' and may be electrically connected to the second pair of terminal pins 702, respectively.

According to one embodiment of the invention, the integrated vertical inductor 1 may further comprise a first spacer flange 150 disposed around the first spool part 111 for separating the first spool part 111 into a first winding section 111*a* and a second winding section 111*b*. The first winding section 111*a* is closer to the upper flange 120 and is farther from the intermediate flange 140, and the second winding section 111*b* is closer to the intermediate flange 140 and is farther from the upper flange 120.

According to one embodiment of the invention, the integrated vertical inductor 1 may further comprise a second spacer flange 160 disposed around the second spool part 112 for separating the second spool part 112 into a third winding section 112*a* and a fourth winding section 112*b*. The third winding section 112*a* is closer to the intermediate flange 140 and is farther from the base structure 130, and the second winding section 112*b* is closer to the base structure 130 and is farther from the intermediate flange 140.

Figure 5:
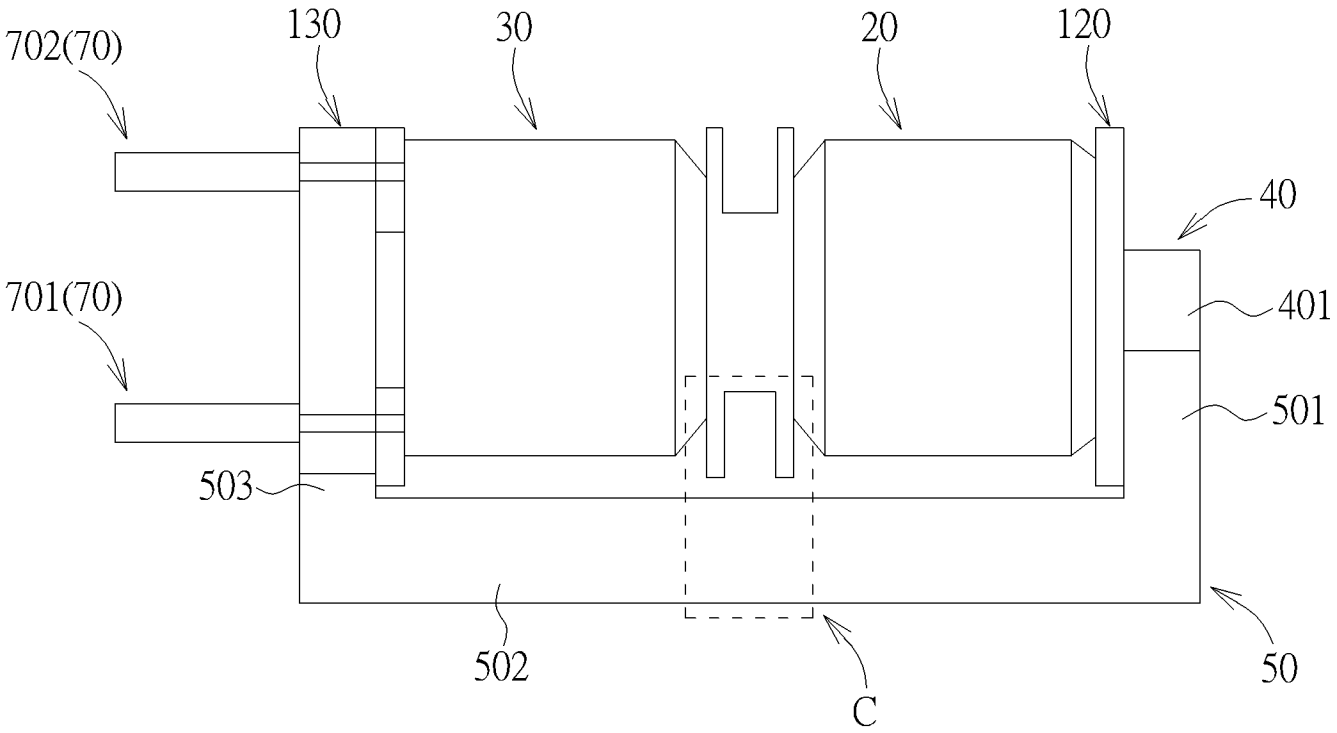
FIG. 5 and FIG. 6 are schematic side views of the integrated vertical inductor according to various embodiments of the invention.
Figure 6:
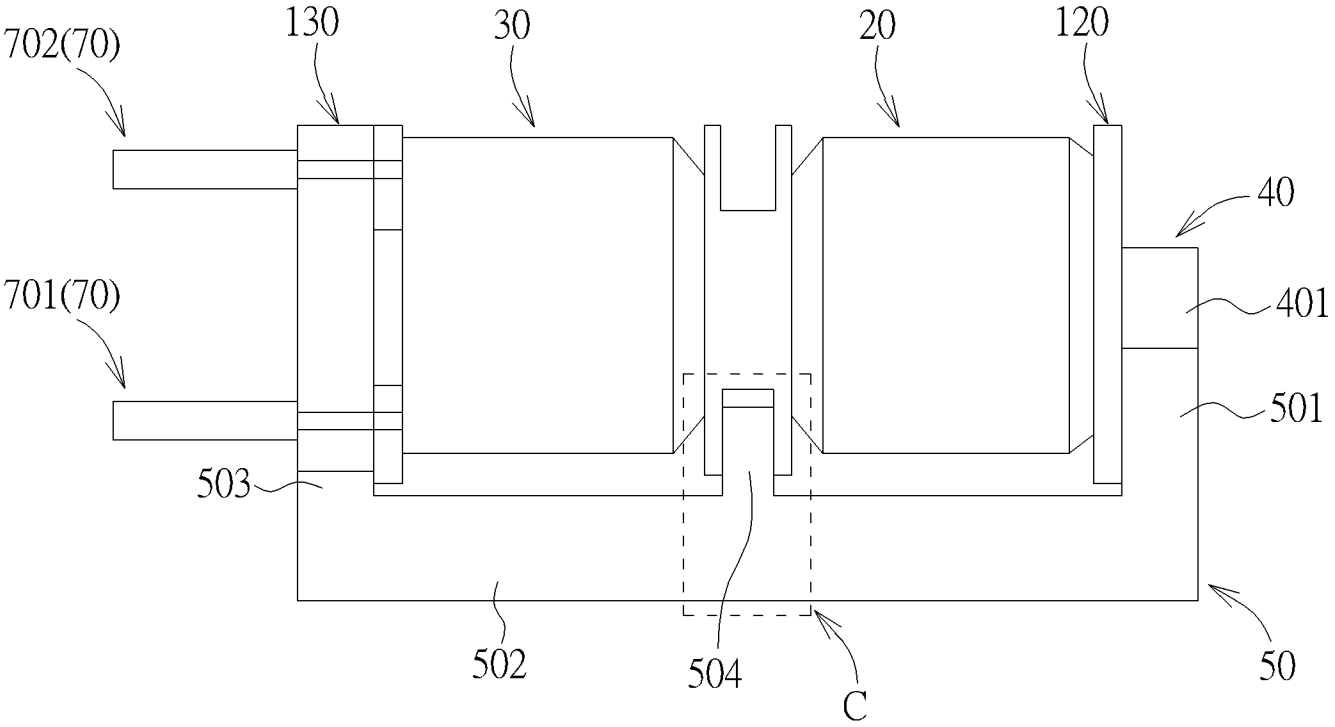

Please refer to FIG. 5 and FIG. 6. FIG. 5 and FIG. 6 are schematic side views of the integrated vertical inductor according to various embodiments of the invention. As shown in FIG. 5, the second magnetic core piece 50 is a U core and a spacing exists in the region C indicated by dashed line. As shown in FIG. 6, the second magnetic core piece 50 is an E core and a middle leg 504 (or middle convex structure) extends into the space in the region C indicated by dashed line.

Figure 7:
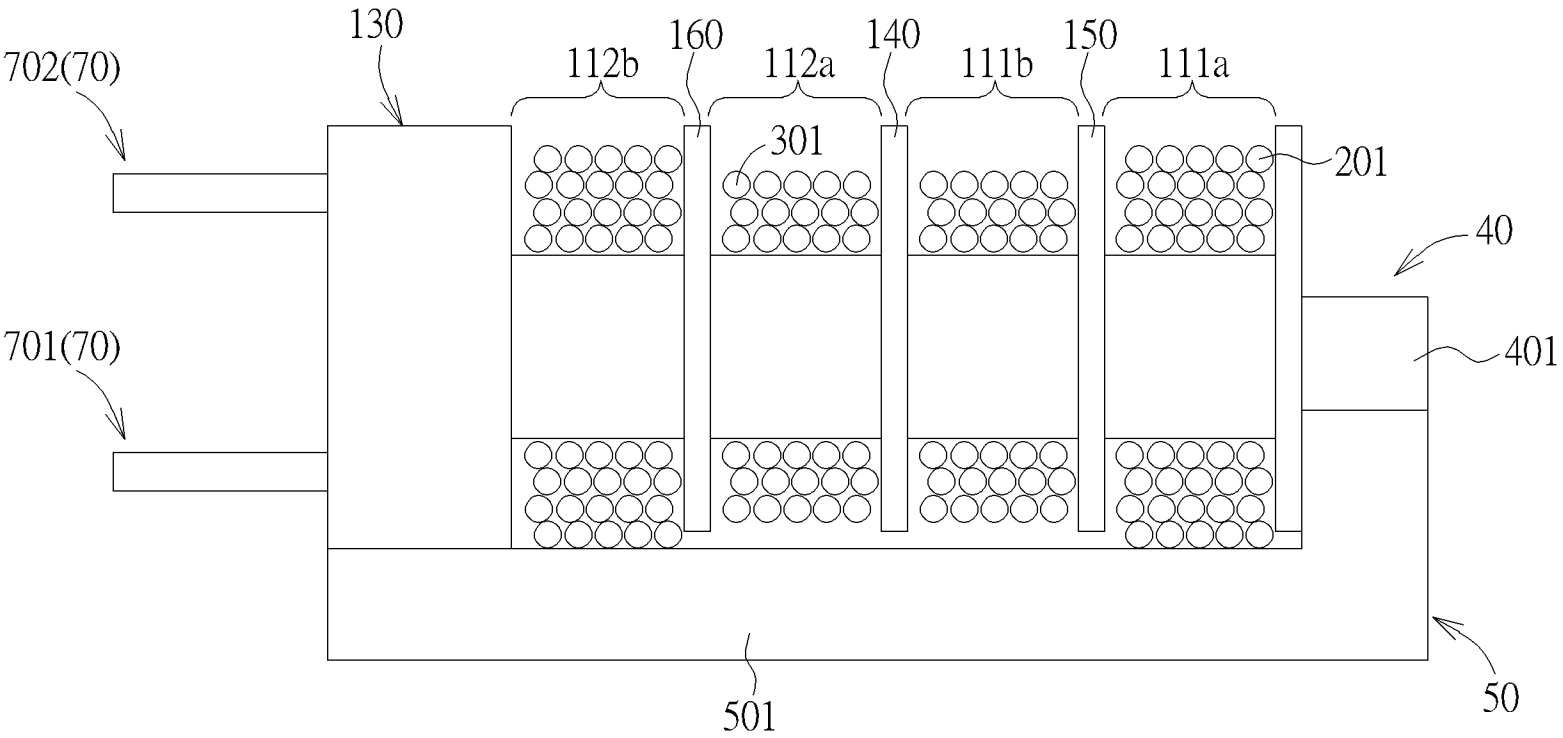
FIG. 7 is a schematic, cross-sectional view of the integrated vertical inductor of FIG. 1 showing number of turns of the first wire and second wire.

According to one embodiment of the invention, as shown in FIG. 7, a number of turns of the first wire 201 in the first winding section 111*a* may be greater than a number of turns of the first wire 201 in the second winding section 111*b*. According to one embodiment of the invention, a number of turns of the second wire 301 in the fourth winding section 112*b* may be greater than a number of turns of the second wire 301 in the third winding section 112*a*. According to another embodiment, the number of turns of the first wire 201 in the first winding section 111*a* is different from the number of turns of the first wire 201 in the second winding section 111*b*. According to still another embodiment, the number of turns of the second wire 301 in the third winding section 112*a* is different from the number of turns of the second wire 301 in the fourth winding section 112*b*.

The present invention includes at least the following advantages, features and/or benefits:

1. Occupied area on printed circuit board (PCB) is small.

Traditionally, two common-mode windings are respectively disposed on the center column or side column of an E core or U core. In the present disclosure, the winding (group) is wound on a single vertical bobbin, and the single vertical bobbin sleeves the I core. Because the I core is integrally formed structure, two common-mode windings (groups) are arranged adjacent to each other and concentrated in a single vertical bobbin. That is, there is no gap in the standing direction of the I core in the bobbin.

The I core is directly installed into the bobbin from the top toward the bottom and the bottom portion of I core is contacted with the bottom plate of the welding surface below the bobbin. E core or U core is laterally bonded to the I core. The two gaps produced by the bonding structure can be smaller, thereby providing a higher common-mode inductance or differential-mode inductance, of which the common-mode inductance is mainly enhanced and the differential-mode inductance is indirectly increased.

Furthermore, the base structure of the bobbin has a horizontal or lateral opening, so that a horizontal extension structure at the lower part of the E core or the U core can be inserted, and the horizontal opening covers the bottom surface of the horizontal extension structure at the lower part of the E core or the U core. Two common-mode windings (group) are disposed only around the vertical I core, so that it can increase the core utilization rate.

In the high inductive reactance characteristics of high number of turns, for example, the common-mode inductance value is more than 5 mH and the differential-mode inductance value is more than 500 μH, can also be achieved to shrink the length*width of the bottom of the element, for example, 8.8 mm*8.8 mm (common-mode inductance value=20 mH, differential-mode inductance value=500 μH), shrinkage by 60%, effectively reducing the occupied area occupied on PCB. The height of the device, for example 19 mm, is greater than the side length of the bottom surface (e.g., 8.8 mm).

Due to the width of the horizontal structure at the lower part of the E core or the U core is significantly reduced, in order to enhance the hi-pot (between the two groups of windings or pins, or insulation pressure of the core to the windings), the horizontal structure at the lower part of E core or U core is retracted to the lateral opening of the bobbin. That is, the bobbin covers the horizontal structure at the lower part of E/U core and I core.

The present disclosure provides a vertical IE type and IU type architecture, different from current designs on the market characterized by winding two windings respectively on both sides of sub-slot bobbin, and slaving I core directly into the bobbin, and then assembling with the E core or U core. In order to solve the automation and safety issues resulting from the vertical inductance deliberately reduced the projection area, the present disclosure provides a special bobbin design making the vertical inductance under the demand such as high differential mode inductance (>500 μH) and high common mode inductance (>5 mH), while still maintaining a highly automated and in line with safety features.

2. Magnetic material structure may be incorporated between the two windings.

(1) A magnetic material structure may be applied between the two windings, for example, coating or disposing the magnetic material at the middle convex structure of E core or at the interval between two windings of bobbin, to increase the magnetic field between two windings (groups), thereby increasing the value of leakage inductance.

(2) The middle convex structure of E core extends to the interval between two windings of bobbin. Tenon function can be achieved by assembling E core and bobbin assembly to greatly increase its reliability.

3. Winding design with reduced EMI noise.

(1) Number of turns of windings (groups) utilizes multi-section (>2 section), i.e., number of turns of windings (groups) of two inner grooves (70 turns) is less than that of the two outer grooves (80 turns).

(2) Winding (group) involves asymmetric winding arrangement. The use of asymmetrical arrangement makes the number of layer of winding (group) increase and thereby increasing the stray capacitance between the winding (group). The larger stray capacitance is, the lower capacitive reactance will be, which can reduce the EMI noise on the circuit transmitted to other electronic devices and affect the operation of other electronic devices to obtain better EMI suppression effect.

4. Core box design.

Hiding the bottom core in the box of bobbin solves the problem of pin to core Hi-pot flashover in the vertical inductance elements resulting from shrinking the occupied area on PCB. It is also easier to position the I core, U core or E core during assembly. I core and U core or E core can accurately engage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated vertical inductor, comprising:

a bobbin comprising an elongated, hollow tube, an upper flange disposed at an upper end of the elongated, hollow tube, and a base structure integrated with a lower end of the elongated, hollow tube, wherein the elongated, hollow tube comprises a first spool part and a second spool part disposed between the upper flange and the base structure, wherein the second spool part extends coaxially from the first spool part, wherein the elongated, hollow tube comprises a central opening extending along its longitudinal direction, and wherein the base structure comprises a lateral opening communicating with the central opening;

a first coil unit comprising windings of first wire wound on the first spool part;

a second coil unit comprising windings of second wire wound on the second spool part;

an intermediate flange disposed on the elongated, hollow tube between the first spool part and the second spool part, wherein the first coil unit is separated from the second coil unit by the intermediate flange;

a first magnetic core piece inserted in the central opening of the elongated, hollow tube;

a second magnetic core piece juxtaposed with the first magnetic core piece, wherein the intermediate flange comprises an intermediate recessed structure for accommodating a connecting bar of the second magnetic core piece, wherein the intermediate flange comprises two first arm portions, and wherein each of the two first arm portions comprises a first wire guiding groove for guiding the first wire from the first coil unit, and wherein an entire bottom surface of a lower leg of the second magnetic core piece and a bottom surface of the lower portion of the first magnetic core piece are covered with the base structure and are not exposed; and a plurality of electrodes disposed on a bottom surface of the base structure.

2. The integrated vertical inductor according to claim 1, wherein the elongated, hollow tube has a rectangular cuboidal shape with a longitudinal length.

3. The integrated vertical inductor according to claim 1, wherein the elongated, hollow tube has a tube axis oriented vertical to a mounting surface of a device.

4. The integrated vertical inductor according to claim 1, wherein the lower leg of the second magnetic core piece is joined to the lower portion of the first magnetic core piece by an adhesive layer in the lateral opening.

5. The integrated vertical inductor according to claim 1, wherein the first magnetic core piece and the second magnetic core piece are selected from a group consisting of I-U core, I-E core, L-L core, or L-F core.

6. The integrated vertical inductor according to claim 1, wherein the first coil unit and the second coil unit are arranged in asymmetric windings.

7. The integrated vertical inductor according to claim 1, wherein the upper flange comprises an upper recessed structure for tenoning an upper leg of the second magnetic core piece, wherein the intermediate recessed structure for tenoning the connecting bar of the second magnetic core piece.

8. The integrated vertical inductor according to claim 7, wherein the upper leg of the second magnetic core piece is joined to an upwardly protruding portion of the first magnetic core piece, which protrudes from the central opening.

9. The integrated vertical inductor according to claim 1, wherein the base structure comprises a lower recessed structure for tenoning the lower leg of the second magnetic core piece, wherein the intermediate recessed structure for tenoning the connecting bar of the second magnetic core piece.

10. The integrated vertical inductor according to claim 9, wherein the base structure comprises two second arm portions around the lower recessed structure.

11. The integrated vertical inductor according to claim 10, wherein each of the two second arm portions comprises a second wire guiding groove for guiding a first end of the first wire of the first coil unit to a bottom surface of the base structure.

12. The integrated vertical inductor according to claim 11, wherein the plurality of electrodes comprises:

a first pair of terminal pins installed on the bottom surface of the base structure, wherein the first pair of terminal pins is situated adjacent to the two second arm portions; and a second pair of terminal pins installed on the bottom surface of the base structure, wherein the second pair of terminal pins is situated adjacent to an edge that is opposite to the two second arm portions of the base structure.

13. The integrated vertical inductor according to claim 12, wherein the first wire of the first coil unit is guided to the bottom surface of the base structure through the second wire guiding groove and is electrically connected to one of the first pair of terminal pins by soldering.

14. The integrated vertical inductor according to claim 12 further comprising:

a third wire guiding groove for guiding the second wire of the second coil unit to the bottom surface of the base structure.

15. The integrated vertical inductor according to claim 14, wherein the second wire of the second coil unit is guided to the bottom surface of the base structure through the third wire guiding groove and is electrically connected to one of the second pair of terminal pins.

16. The integrated vertical inductor according to claim 12, wherein the two first arm portions are disposed around the intermediate recessed structure and are on a side that is opposite to the second pair of terminal pins.

17. The integrated vertical inductor according to claim 1 further comprising:

a first spacer flange on the first spool part for separating the first spool part into a first winding section and a second winding section, wherein the first winding section is closer to the upper flange and is farther from the intermediate flange, and the second winding section is closer to the intermediate flange and is farther from the upper flange; and a second spacer flange on the second spool part for separating the second spool part into a third winding section and a fourth winding section, wherein the third winding section is closer to the intermediate flange and is farther from the base structure, and the second winding section is closer to the base structure and is farther from the intermediate flange.

18. The integrated vertical inductor according to claim 17, wherein a number of turns of the first wire in the first winding section is different from a number of turns of the first wire in the second winding section.

19. The integrated vertical inductor according to claim 18, wherein a number of turns of the first wire in the first winding section is greater than a number of turns of the first wire in the second winding section.

20. The integrated vertical inductor according to claim 17, wherein a number of turns of the second wire in the fourth winding section is different from a number of turns of the second wire in the third winding section.

21. The integrated vertical inductor according to claim 20, wherein a number of turns of the second wire in the fourth winding section is greater than a number of turns of the second wire in the third winding section.

22. An integrated vertical inductor, comprising:

a bobbin comprising an elongated, hollow tube, an upper flange disposed at an upper end of the elongated, hollow tube, and a base structure integrated with a lower end of the elongated, hollow tube, wherein the elongated, hollow tube comprises a first spool part and a second spool part disposed between the upper flange and the base structure, wherein the second spool part extends coaxially from the first spool part, wherein the elongated, hollow tube comprises a central opening extending along its longitudinal direction, and wherein the base structure comprises a lateral opening communicating with the central opening, wherein the base structure comprises two second arm portions around a lower recessed structure;

a first coil unit comprising windings of first wire wound on the first spool part;

a second coil unit comprising windings of second wire wound on the second spool part;

an intermediate flange disposed on the elongated, hollow tube between the first spool part and the second spool part, wherein the first coil unit is separated from the second coil unit by the intermediate flange;

a first magnetic core piece inserted in the central opening of the elongated, hollow tube;

a second magnetic core piece juxtaposed with the first magnetic core piece, wherein the intermediate flange comprises an intermediate recessed structure for accommodating a connecting bar of the second magnetic core piece, wherein the intermediate flange comprises two first arm portions, and wherein each of the two first arm portions comprises a first wire guiding groove for guiding the first wire from the first coil unit, wherein each of the two second arm portions comprises a second wire guiding groove for guiding a first end of the first wire of the first coil unit to a bottom surface of the base structure; and a plurality of electrodes disposed on a bottom surface of the base structure, wherein the plurality of electrodes comprises a first pair of terminal pins installed on the bottom surface of the base structure, wherein the first pair of terminal pins is situated adjacent to the two second arm portions; and a second pair of terminal pins installed on the bottom surface of the base structure, wherein the second pair of terminal pins is situated adjacent to an edge that is opposite to the two second arm portions of the base structure, wherein the first wire of the first coil unit is guided to the bottom surface of the base structure through the second wire guiding groove and is electrically connected to one of the first pair of terminal pins by soldering.

* * * * *